US005456565A

United States Patent [19]

Pigott et al.

[11] Patent Number: 5,456,565

[45] Date of Patent: Oct. 10, 1995

[54] FORKLIFT TINE CLAMP ASSEMBLY

[76] Inventors: Schuyler F. Pigott, 1122 N. Patton St., Arlington Heights, Ill. 60004; Brandon L. Pigott, 1017 Elmwood Ave., Wilmette, Ill. 60091; Peter S. Pigott, 803 Elmwood Ave., Wilmette, Ill. 60091; Maurice J. Pigott, 591 Cherry St., Winnetka, Ill. 60093

[21] Appl. No.: 157,651

[22] Filed: Nov. 24, 1993

[51] Int. Cl.[6] ..... B66F 19/00

[52] U.S. Cl. ..... 414/607; 187/222; 414/785

[58] Field of Search ..... 414/607, 785, 414/663, 664, 668, 671, 667, 659, 660, 641, 642, 787, 631, 632, 629, 619, 722, 724, 685; 187/232, 222, 237

[56] References Cited

U.S. PATENT DOCUMENTS

| | | | |
|---|---|---|---|
| 2,827,189 | 3/1958 | Knudstrup | 414/607 |
| 2,956,701 | 10/1960 | Larson | 414/608 X |
| 3,966,069 | 6/1976 | Fathauer | 414/607 |
| 4,102,464 | 7/1978 | Schuster | 414/607 X |
| 4,669,949 | 6/1987 | Sutton | 414/607 X |
| 4,890,973 | 1/1990 | Frison et al. | 414/607 |
| 5,056,982 | 10/1991 | Stockham | 414/607 |
| 5,221,176 | 6/1993 | Allen et al. | 414/607 X |

FOREIGN PATENT DOCUMENTS

| | | | |
|---|---|---|---|
| 1193943 | 11/1959 | France | 414/607 |
| 2639932 | 6/1990 | France | 414/607 |
| 3639126 | 5/1988 | Germany | 414/607 |

*Primary Examiner*—Frank E. Werner
*Attorney, Agent, or Firm*—Wallenstein & Wagner, Ltd.

[57] ABSTRACT

A clamping assembly (10) adapted for attaching to a pair of substantially parallel forklift tines (14) is disclosed. The assembly (10) includes an L-shaped support bar (18) having a horizontal leg (18*a*) with at least one slot (26) therein and a vertical leg (18*b*). A fastener (27,28) passing through the slot (26) interconnects the support bar (18) to a clamp plate (22). A pair of slider bars (20), each having a pair of substantially vertical counterbores (24*a*) therethrough, are connected by separate adjustable fasteners (24) to the clamp plate (22).

7 Claims, 2 Drawing Sheets

FORKLIFT TINE CLAMP ASSEMBLY

TECHNICAL FIELD

The present invention relates to an apparatus for protecting pallets during transportation by a mechanical lifting device, such as a forklift, and more particularly, to a clamping assembly adapted for attaching to the tines of a forklift.

BACKGROUND OF THE INVENTION

Today, it is common to transport and store goods on pallets. The transporting of pallets is generally accomplished through the use of a forklift. The forklift operator generally drives the forklift up to the pallet, lowers the tines of the lift close to or onto the ground, and inserts the forklift tines into channels provided within the pallet. The tines, along with the pallet, are then lifted and moved. Prior to inserting the tines, a forklift operator must estimate the distance between the ground and the channel within the pallet. Often, the operator is unable to clearly see the channel or make a proper determination. As a result, the operator may contact with the forklift tines the side of the pallet or the palletized goods causing damage.

Accordingly, there is a need for a sturdy, device attachable to the forklift tines to assist the operator and reduce the incidents of damage to pallets and the goods thereon. The present invention provides such a device. Because the distance between tines may vary, the device must also be adjustable.

SUMMARY OF THE INVENTION

The present invention is an apparatus for use with mechanical lifting devices, such as forklift trucks. Specifically, a forklift tine clamping assembly is disclosed that keeps the tines of a forklift or lifting device at a predetermined height and acts as a bumper to pallets. Use of the clamping assembly enables the lowered tines to be easily inserted into pallet channels, thereby eliminating the need for channel height estimation by the forklift operator.

The assembly of the present invention comprises spacer means for preventing the bottom surfaces of the tines from contacting the ground, locking means for releasably securing the spacer means to the tines, and an adjustment means adapted for adjusting the spacer means to tines of varying distances therebetween. The spacer means include a pair of slider bars, and the locking means includes at least one substantially vertical bore within each slider bar, the vertical bore being adapted for receiving a first adjustable fastener. The adjustment includes an elongated support bar having at least one slot therein and a second adjustable fastener passing through the slot, retaining a clamp plate to the support bar. The support bar has an L-shaped cross section with a horizontal leg with at least one slot therein, and a vertical leg, the vertical leg acting as a pallet bumper when the clamping assembly is installed on the forklift.

Other advantages and aspects of the present invention will become apparent upon reading the following description of the drawings and the detailed description of the invention.

BRIEF DESCRIPTION OF DRAWINGS

In order that the present invention may be understood, it will now be described by way of example, with reference to the accompanying drawings in which.

DETAILED DESCRIPTION

Figure 1:
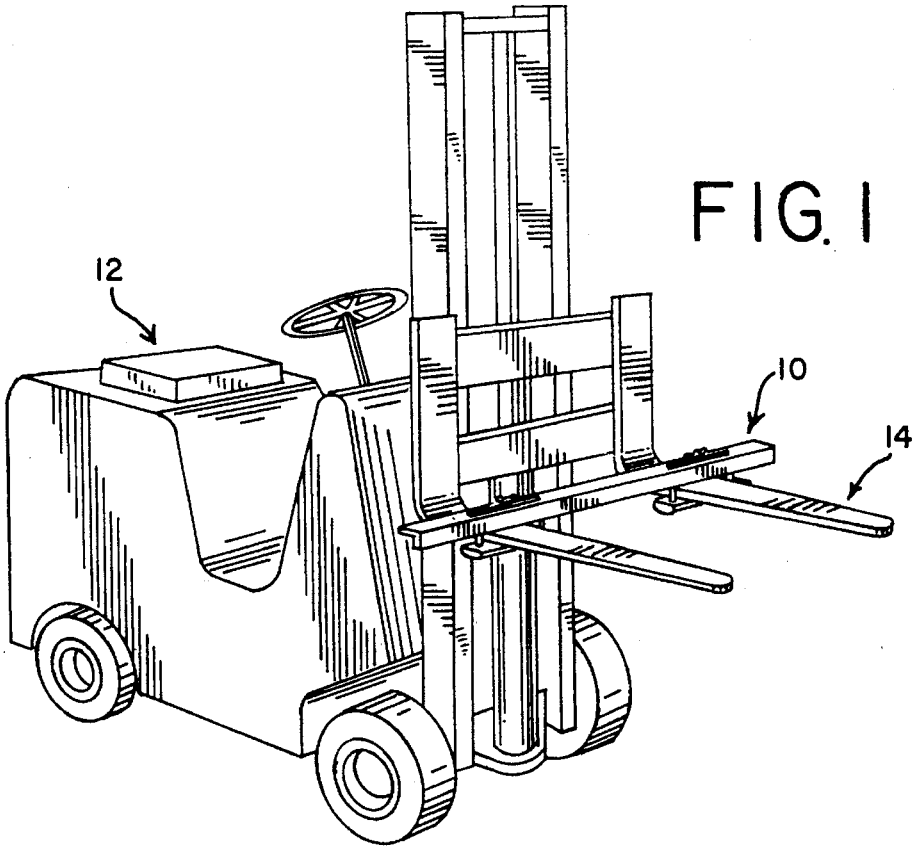
FIG. 1 is a perspective view showing a forklift with its tines and the clamping assembly of the present invention installed thereon.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the sole embodiment illustrated.

The forklift tine clamping assembly, generally designated by the reference numeral 10, is shown in FIG. 1 as it is installed on a pair of forklift tines 14. The clamping assembly 10 includes spacer means to ensure that the bottoms of the tines do not contact the floor or ground. Such spacer means also ensures that the distal ends of the tines do not contact the base 13 of the pallet 16. In the embodiment shown, the spacer means includes slider bars 20. Locking means comprising an adjustable fastener 24 for releasably securing the spacer bars 20 in a position beneath the forklift tines 14 and adjustment means for allowing the adjustment of the space or gap between the slider bars 20 to correspond substantially to the space between the tines 14 are also provided.

In particular, the slider bars 20 are connected to clamp plates 22, which are connected to a support bar 18. The adjustment means just noted includes a generally L-shaped support bar 18 or channel member having a horizontal leg **18*a* and a vertical leg 18*b*. A second adjustable fastener 27, such as a countersunk bolt 27*a* with a head 27*d* and a threaded end 27*c* and a wing nut 27*b* combination, cooperate with the support bar 18. Specifically, as seen in the exploded view of FIG. 5, the countersunk bolt 27*a* passes through a internally threaded aperture 22*b* of the clamp plate 22 abutting the bottom of the horizontal leg 18*a* of the support bar 18 and through a slot 26 in the horizontal leg 18*a* of the support bar 18. The countersunk bolt 27*a* and wing nut 27*b* act in combination when tightened to releasably retain the clamp plate 22 below the horizontal leg 18*a* of the support bar 18. Because the support bar 18 has a plurality of slots 26 therein, the distance between the clamp plates 22 (and connected slider bars 18**) may be varied to accommodate tines of differing distances therebetween.

Figure 2:
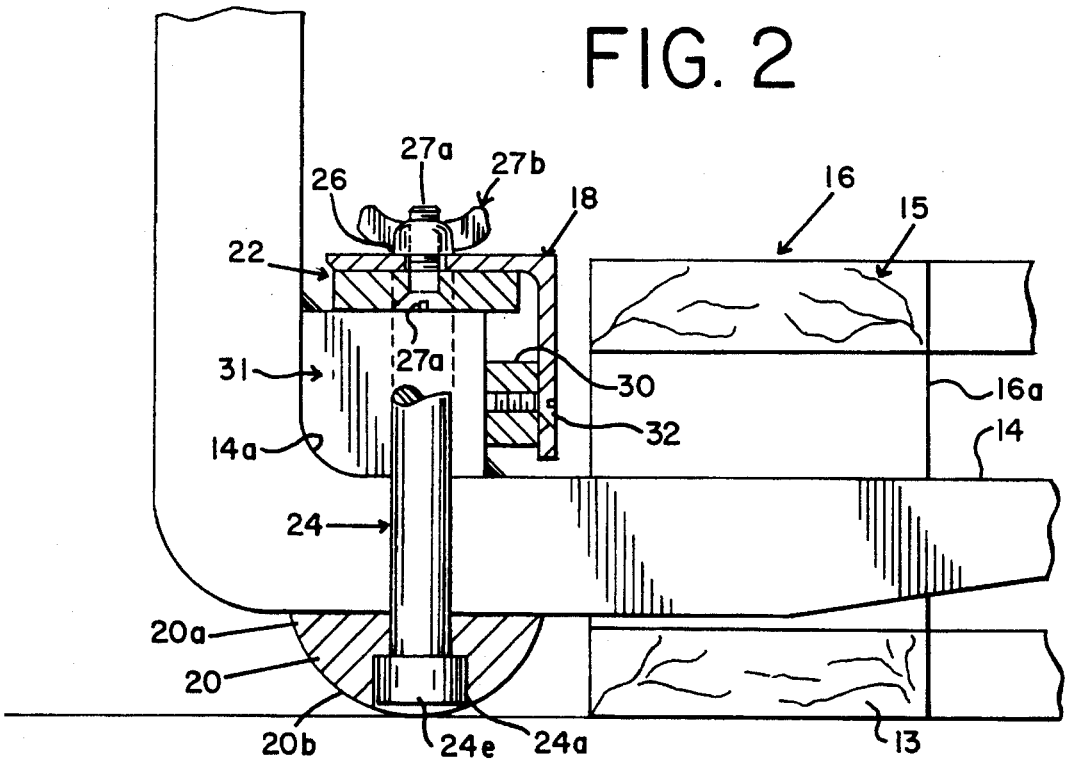
FIG. 2 is an enlarged side sectional view of the forklift tine clamping assembly of the present invention.
Figure 5:
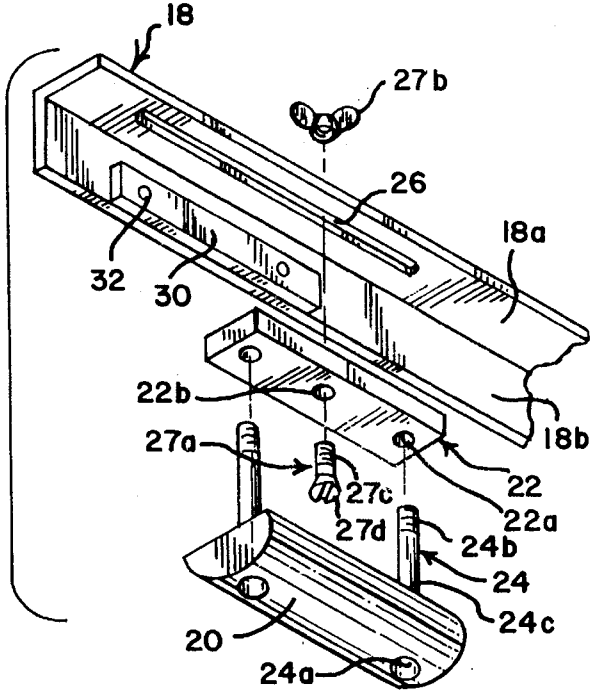

The slider bars 20, shown in FIGS. 2 and 5, have preferably a half-cylindrical cross section to maximize the contact area with the forklift tines 14 (rectangular) and to minimize the surface area contacting the ground or floor (linear). Consequently, each slider bar 20 has a substantially flat first surface **20*a* and a second arcuate surface 20*b*. This first flat surface 20*a* is adapted for abutting the bottom of the tines 14, while the second arcuate surface 20*b* is adapted for contact with the ground when the tines 14 are in a lowered position (FIG. 2). The slider bars 20 can be constructed of any suitable material including metal, plastic or wood. Metal is preferred for its durability because the slider bars 20** are in frequent contact with the ground.

Figure 4:
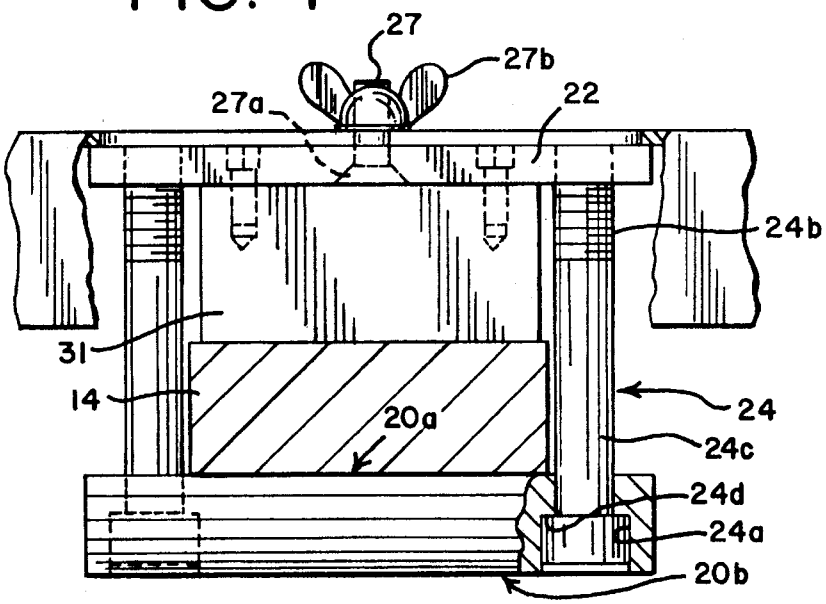
FIG. 4 is a partial front sectional view of the clamping assembly of FIGS. 1–3; and, FIG. 5 is a partial exploded perspective view of the clamping assembly of FIGS. 1–4.

As shown in FIGS. 2 and 4, each slider bar 20 is releasably secured under the forklift tines 14 by locking means. The locking means includes a plurality of vertical bores or counterbores 24*a* in each of the slider bars 20, which extend through the slider bars 20 and are adapted to receive adjustable fastening means. The adjustable fastening means can include any suitable fastening means, but is preferably internal wrenching bolts 24. The wrenching bolts 24 comprise a threaded portion 24*b* and an unthreaded head portion 24*c*. The unthreaded head portion 24*c* of the wrenching bolt 24 abuts a ledge 24*d* within the counterbore 24*a* of the slider bar 20 so that the wrenching bolt 24 is prevented from passing completely through the slider bar 20 (FIG. 4). In addition, the top of the head portion 24*c* sits below the outside arcuate surface 20*b* of the slider bar 20, and is thus protected from wear and tear. The threaded portion 24*b* of the wrenching bolt 24 is secured to the clamp plate 22, which has internally threaded apertures 22*a* therein that are adapted to receive the threaded portion of the wrenching bolts 24. Consequently, by tightening the wrenching bolt 24, such as with an Allen wrench, the slider bar 20 is secured to the clamp plate 22 with the tine 14 disposed therebetween.

The support bar 18 can also be constructed from any strong material, such as a metal or a hard plastic. The horizontal leg 18*a* of the support bar 18 has at least one slot 26 therein, and preferably two narrow horizontal slots 26, one located on each outside third portion of the horizontal leg 18*a* (FIG. 5). As noted previously, the slots 26 are adapted for receiving a second adjustable fastener 27. The vertical leg 18*b* of the support bar 18 has a spacer bar 30 connected to its inside surface, so as to permit the outer surface of the support bar 18, the surface facing the pallet 16, to act as bumper.

Figure 3:
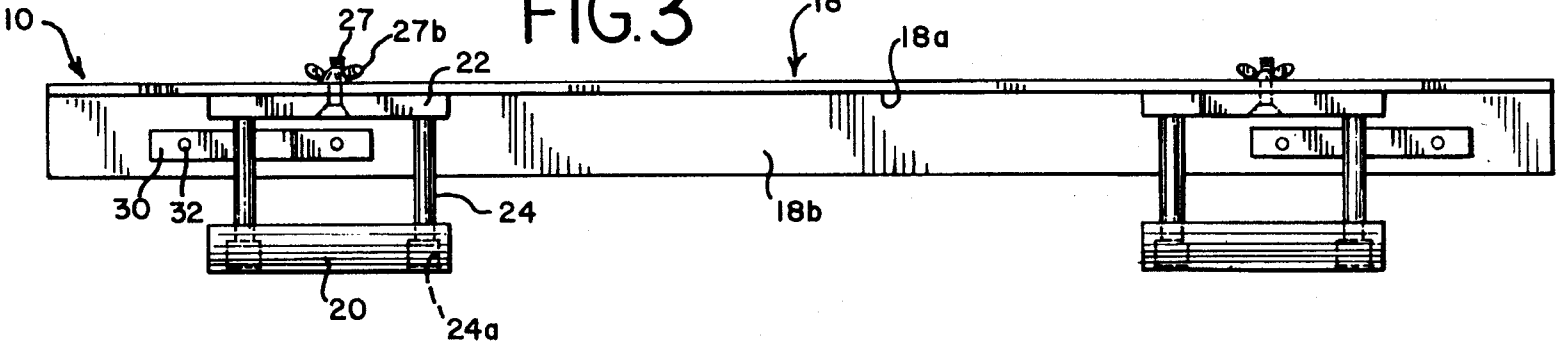
FIG. 3 is a front view of the clamping assembly of FIGS. 1 and 2.

As previously noted, and as seen in FIGS. 2, 3 and 5, a spacer bar 30 is connected to the inside surface of the vertical leg 18*b* of the support bar 18. The spacer bar 30 can be of any shape, but is preferably rectangular so as to fit easily under the horizontal leg 18*a* of the support bar 18 and against the vertical leg 18*b* of the support bar 18. The spacer bar 30 is secured to the vertical leg 18*b* of the support bar 18 by a screw 32, permitting easy adjustment of the spacer bar 30.

As shown in FIG. 2, in use, the clamping assembly 10 is positioned adjacent the elbows 14*a* of the forklift tines 14. A block 31 is placed in the inner corners formed by the inner surfaces of the tines' elbows 14*a*. The block 31 can be constructed from structural tubing, steel or wood. The spacer bar 30 and the clamp plate 22 are placed against the block 31 and secured to the support bar 18.

In FIG. 1, the forklift tine clamp assembly 10 is positioned on a forklift 12 at the elbow portion 14*a* of the tines 14. In this position, the forklift tines 14 are frictionally engaged and held between the slider bars 20, beneath the tines 14, and the support bar 18, secured to the block 31 on top of the tines 14. The tines 14 are also disposed between the pair of wrenching bolts 24 connecting each slider bar 20 to the threaded apertures 22*a* of the clamp plate 22. When the tines 14 are lowered close to the ground, such as in preparation to pick up a pallet, the arcuate surface of the slider bars 20 keep the tines 14 from touching the ground. In addition, as seen in FIG. 2, the slider bars 20 maintain the tines 14 at the height of the channels 16*a* of the pallet 16. Thus, with this construction, the forklift operator can easily maneuver the tines 14 into the channels 16*a* without hitting, and possibly damaging, the pallet 16 and its cargo.

While a specific embodiment has been illustrated and described, numerous modifications come to mind without departing from the spirit of the invention and the scope of the accompanying claims.

We claim:

1. A clamping assembly adapted for attaching to a pair of substantially parallel horizontal forklift tines having opposed side, top and bottom surfaces comprising:

at least one slider bar secured below and abutting the bottom surfaces of the tines having side portions extending beyond the side surfaces of the tines for contacting the ground and preventing the bottom surfaces of the tines from contacting the ground;

locking means interconnected to each said slider bar and projecting from said side portions thereof adjacent the side surfaces of the tines to a position above the top surfaces of the tines for releasably securing said slider bar to a position below the tines, said locking means including at least one substantially vertical bore in each said slider bar adapted for receiving a first adjustable fastener, said first adjustable fastener interconnecting said slider bars to a clamp plate, said clamp plate has at least two channels therein with internal threading for receiving first adjustable fasteners, each tine being disposed between said two first adjustable fasteners; and, adjustment means cooperating with said locking means for adjusting said locking means and each said slider bar to tines of varying distance therebetween.

2. The clamping assembly of claim 1 wherein each said first adjustable fastener is an internal wrenching bolt.

3. The clamping assembly of claim 1 wherein said adjustment means includes an elongated support bar having at least one slot therein and a second adjustable fastener passing through said slot and releasably securing said clamp plate to said support bar.

4. The clamping assembly of claim 3 wherein said clamp plate has a substantially vertical countersink therein and said second adjustable fastener is a countersunk bolt and wing nut.

5. The clamping assembly of claim 3 wherein said support bar has an L-shaped cross section having a horizontal leg and a vertical leg, said slot being in said horizontal leg, said vertical leg acting as a pallet bumper and having a spacer bar connected thereto.

6. A clamping assembly adapted for attaching to a pair of substantially parallel forklift tines having top and bottom surfaces comprising:

a pair of slider bars adapted for preventing the bottom surfaces of the tines from contacting the ground, each said slider bar having a substantially flat first surface adapted for abutting the bottom of the tine and a second arcuate surface adapted for contacting the ground;

a pair of substantially vertical counterbores in each said slider bar adapted for receiving a first adjustable fastener, said first adjustable fastener releasably retaining said slider bars to a clamp plate, each tine being frictionally engaged between one said slider bar and said clamp plate, said clamp plate has at least two channels therein with internal threading for receiving first adjustable fasteners, each tine being disposed between said two first adjustable fasteners; and, adjustment means adapted for adjusting said slider bars to tines of varying distance therebetween and including an elongated support bar having at least one slot therein and a second adjustable fastener passing through said slot and releasably securing said clamp plate to said support bar, said support bar having an L-shaped cross section with a horizontal leg and a vertical leg, said slot being in said horizontal leg, said vertical leg acting as a pallet bumper and having a spacer bar connected thereto.

7. The clamping assembly of claim 6 wherein each said first adjustable fastener is an internal wrenching bolt, said clamp plate has a substantially vertical countersink therein, and said second adjustable fastener is a countersunk bolt and wing nut.

* * * * *